US010136735B2

(12) United States Patent
Ocegueda et al.

(10) Patent No.: US 10,136,735 B2
(45) Date of Patent: Nov. 27, 2018

(54) SYSTEMS AND METHODS FOR AIR MATTRESS TEMPERATURE CONTROL

(71) Applicant: POLYGROUP MACAU LIMITED (BVI), Road Town, Tortola (VG)

(72) Inventors: Victor Ocegueda, Baja California (MX); Yifeng Zhang, Xinxiang (CN)

(73) Assignee: Polygroup Macau Limited (BVI), Road Town (VG)

( * ) Notice: Subject to any disclaimer, the term of this patent is extended or adjusted under 35 U.S.C. 154(b) by 313 days.

(21) Appl. No.: 14/945,665

(22) Filed: Nov. 19, 2015

(65) Prior Publication Data

US 2016/0135607 A1 May 19, 2016

Related U.S. Application Data

(60) Provisional application No. 62/081,803, filed on Nov. 19, 2014.

(51) Int. Cl.
*A47C 27/10* (2006.01)
*A47C 21/04* (2006.01)

(52) U.S. Cl.
CPC ..... *A47C 21/048* (2013.01); *A47C 21/044* (2013.01)

(58) Field of Classification Search
CPC ..... A47C 21/048; A47C 27/10
USPC ..... 5/710, 713, 421
See application file for complete search history.

(56) References Cited

U.S. PATENT DOCUMENTS 2,313,864 A 3/1943 Crise
2,432,785 A 12/1947 Moberg
2,493,067 A 1/1950 Goldsmith
2,504,308 A 4/1950 Donkle
2,543,620 A 2/1951 Anderson et al.
2,549,432 A 4/1951 Crowley
2,569,138 A 9/1951 Abbott
2,601,189 A 6/1952 Wales
2,606,996 A 8/1952 Westerberg et al.
(Continued)

FOREIGN PATENT DOCUMENTS

CN 2430901 Y 5/2001
CN 2930467 Y 8/2007
(Continued)

OTHER PUBLICATIONS

European Search Report from related EP 161985973, dated May 11, 2017, 14 pages.
(Continued)

*Primary Examiner* — Fredrick C Conley
(74) *Attorney, Agent, or Firm* — Troutman Sanders LLP; Ryan A. Schneider; Christopher C. Close, Jr.

(57) ABSTRACT

An air temperature control system controls the air temperature inside of an air mattress. The air temperature control system includes an air intake component having inner and outer seals to inhibit or facilitate the flow of air into and out of the air mattress. The air temperature control system also includes a temperature control element in fluid communication with the air intake component. The temperature control element is positioned within the air mattress inside of the outer seal. The air temperature control system further includes a controller configured to direct the air intake component to open and close the inner and outer seals and operation of the temperature control element.

20 Claims, 14 Drawing Sheets

(56) References Cited

U.S. PATENT DOCUMENTS

| | | | | |
|---|---|---|---|---|
| 2,688,070 | A | 8/1954 | Lincoln | |
| 2,697,775 | A | 12/1954 | Licht | |
| 2,715,674 | A | 8/1955 | Abbott et al. | |
| 2,753,435 | A | 7/1956 | Ivar | |
| 2,938,991 | A | 5/1960 | Sullivan et al. | |
| 3,028,477 | A | 4/1962 | Russell | |
| 3,206,654 | A * | 9/1965 | Enge | H01F 7/202 335/281 |
| 3,266,064 | A | 8/1966 | Murray | |
| 3,422,244 | A | 1/1969 | Lauck | |
| 3,444,922 | A | 5/1969 | Dingman | |
| 3,585,356 | A | 6/1971 | Hall | |
| 3,668,367 | A | 6/1972 | Williams | |
| 3,673,381 | A | 6/1972 | Crowley et al. | |
| 3,683,151 | A | 8/1972 | Mills et al. | |
| 3,736,604 | A | 6/1973 | Carson | |
| 3,739,142 | A | 6/1973 | Johns | |
| 3,758,747 | A | 9/1973 | Rohr | |
| 3,760,147 | A | 9/1973 | Tyrey | |
| 3,772,717 | A | 11/1973 | Yuen et al. | |
| 3,840,985 | A | 10/1974 | Miller | |
| 3,928,876 | A | 12/1975 | Starr | |
| 4,070,217 | A | 1/1978 | Alexander et al. | |
| 4,074,107 | A | 2/1978 | Moss | |
| 4,097,717 | A | 6/1978 | Phillips | |
| 4,132,262 | A | 1/1979 | Wibell | |
| 4,139,763 | A | 2/1979 | McMullan et al. | |
| 4,162,393 | A | 7/1979 | Balboni | |
| 4,233,492 | A | 11/1980 | McMullan et al. | |
| 4,388,738 | A | 6/1983 | Wagner | |
| 4,423,308 | A | 12/1983 | Callaway et al. | |
| 4,455,472 | A | 6/1984 | Moss | |
| 4,521,929 | A | 6/1985 | Keefer | |
| 4,652,726 | A | 3/1987 | Femino et al. | |
| 4,656,334 | A | 4/1987 | Endo et al. | |
| 4,777,802 | A | 10/1988 | Feher | |
| 4,797,536 | A | 1/1989 | Handley | |
| 4,798,936 | A | 1/1989 | Johnson | |
| 4,825,047 | A | 4/1989 | Miles | |
| 4,884,304 | A | 12/1989 | Elkins | |
| 4,907,308 | A | 3/1990 | Leininger et al. | |
| 4,937,903 | A | 7/1990 | Joly et al. | |
| 4,974,272 | A | 12/1990 | Liu | |
| 4,984,316 | A | 1/1991 | Simpson et al. | |
| 5,005,240 | A | 4/1991 | Vrzalik | |
| 5,010,608 | A | 4/1991 | Barnett et al. | |
| 5,022,108 | A | 6/1991 | Larson | |
| 6,094,762 | A * | 8/2000 | Viard | A61G 7/05769 177/144 |
| 7,089,618 | B1 | 8/2006 | Metzger | |
| 8,082,615 | B1 | 12/2011 | Alkhattaf | |
| 8,562,773 | B2 | 10/2013 | Lin et al. | |
| 9,156,203 | B2 | 10/2015 | Lin et al. | |
| 9,247,827 | B2 | 2/2016 | Lin et al. | |
| D765,443 | S | 9/2016 | Lin et al. | |
| 2004/0079812 | A1 | 4/2004 | Gagnon | |
| 2005/0095548 | A1 | 5/2005 | Gagnon | |
| 2005/0278863 | A1 | 12/2005 | Bahash et al. | |
| 2006/0150331 | A1 | 7/2006 | Child et al. | |
| 2006/0151459 | A1 | 7/2006 | Ku | |
| 2006/0166082 | A1 | 7/2006 | Turner et al. | |
| 2006/0191886 | A1 | 8/2006 | Pak | |
| 2006/0198617 | A1 | 9/2006 | Sirkis | |
| 2006/0278628 | A1 | 12/2006 | Foggett et al. | |
| 2007/0006386 | A1 | 1/2007 | Han | |
| 2007/0068916 | A1 | 3/2007 | Augustine et al. | |
| 2007/0080155 | A1 | 4/2007 | Augustine et al. | |
| 2007/0107134 | A1 | 5/2007 | Pittman | |
| 2007/0221645 | A1 | 9/2007 | Castracane et al. | |
| 2007/0257018 | A1 | 11/2007 | Huang | |
| 2007/0272673 | A1 | 11/2007 | Keane | |
| 2007/0277312 | A1 | 12/2007 | Garrigues | |
| 2008/0047945 | A1 | 2/2008 | Yip | |
| 2008/0156786 | A1 | 7/2008 | Choi | |
| 2008/0173629 | A1 | 7/2008 | Deibel et al. | |
| 2009/0008376 | A1 | 1/2009 | Yip | |
| 2009/0078690 | A1 | 3/2009 | Lee et al. | |
| 2010/0071130 | A1 * | 3/2010 | Frias | A47C 21/044 5/421 |
| 2010/0089898 | A1 | 4/2010 | Lee | |
| 2010/0107334 | A1 | 5/2010 | Yi | |
| 2010/0192299 | A1 | 8/2010 | Schermel et al. | |
| 2010/0247356 | A1 * | 9/2010 | Tsai | A47C 27/082 417/423.14 |
| 2010/0287701 | A1 | 11/2010 | Frias | |
| 2010/0293715 | A1 | 11/2010 | Sakamoto et al. | |
| 2010/0319125 | A1 | 12/2010 | Ko | |
| 2011/0031230 | A1 | 2/2011 | Kim | |
| 2011/0035880 | A1 | 2/2011 | Cole et al. | |
| 2011/0067178 | A1 | 3/2011 | Lee | |
| 2011/0115635 | A1 | 5/2011 | Petrovski et al. | |
| 2011/0233185 | A1 | 9/2011 | Augustine et al. | |
| 2011/0252562 | A1 | 10/2011 | Mikkelsen et al. | |
| 2011/0296611 | A1 | 12/2011 | Marquette et al. | |
| 2012/0022620 | A1 | 1/2012 | Khodak et al. | |
| 2012/0110734 | A1 | 5/2012 | An | |
| 2012/0227182 | A1 | 9/2012 | Brykalski et al. | |
| 2012/0233773 | A1 | 9/2012 | Suzuki | |
| 2012/0272450 | A1 | 11/2012 | Pittman | |
| 2012/0273475 | A1 | 11/2012 | An | |
| 2012/0279953 | A1 | 11/2012 | Augustine et al. | |
| 2012/0311783 | A1 | 12/2012 | Chiang et al. | |
| 2012/0311784 | A1 | 12/2012 | Yoon | |
| 2012/0312797 | A1 | 12/2012 | Augustine et al. | |
| 2012/0317720 | A1 | 12/2012 | Chiang et al. | |
| 2013/0228268 | A1 | 9/2013 | Lin et al. | |
| 2013/0230670 | A1 | 9/2013 | Lin et al. | |
| 2013/0230671 | A1 | 9/2013 | Lin et al. | |
| 2014/0277611 | A1 | 9/2014 | Nunn et al. | |
| 2014/0332139 | A1 | 11/2014 | Lin et al. | |
| 2014/0332142 | A1 | 11/2014 | Lin et al. | |
| 2015/0201760 | A1 | 7/2015 | Lin et al. | |
| 2015/0335164 | A1 | 11/2015 | Liu | |

FOREIGN PATENT DOCUMENTS

| | | | |
|---|---|---|---|
| CN | 200970039 | Y | 11/2007 |
| CN | 201019353 | Y | 2/2008 |
| CN | 201032956 | Y | 3/2008 |
| CN | 201266324 | Y | 7/2009 |
| CN | 201599174 | U | 10/2010 |
| CN | 202234135 | U | 5/2012 |
| CN | 102602598 | A | 7/2012 |
| CN | 202536548 | U | 11/2012 |
| CN | 202536827 | U | 11/2012 |
| CN | 102990929 | A | 3/2013 |
| CN | 103110297 | A | 5/2013 |
| CN | 202919638 | U | 5/2013 |
| CN | 203137718 | U | 8/2013 |
| CN | 203137719 | U | 8/2013 |
| CN | 203296407 | U | 11/2013 |
| CN | 103600502 | A | 2/2014 |
| CN | 203735815 | U | 7/2014 |
| CN | 203852092 | U | 10/2014 |
| CN | 102578859 | B | 11/2014 |
| CN | 204218433 | U | 3/2015 |
| CN | 204232695 | U | 4/2015 |
| CN | 102578860 | B | 5/2015 |
| CN | 204599945 | U | 9/2015 |
| CN | 303354844 | S | 9/2015 |
| WO | 2009122123 | A1 | 10/2009 |
| WO | 2013130117 | A1 | 9/2013 |
| WO | 2014025083 | A1 | 2/2014 |

OTHER PUBLICATIONS

Yang Zhaohu et al., "The Design of Autocontrol System for Temperature and Humidity", Meteorological, Hydrological and Marine Instruments, Jun. 30, 2005.

(56) References Cited

OTHER PUBLICATIONS

The First Chinese Office Action for 2015108082451 dated Aug. 20, 2018.

* cited by examiner

SYSTEMS AND METHODS FOR AIR MATTRESS TEMPERATURE CONTROL

CROSS REFERENCE TO RELATED APPLICATIONS

This application claims the benefit of U.S. Provisional Application No. 62/081,803, titled "SYSTEMS AND METHODS FOR AIR MATTRESS TEMPERATURE CONTROL," filed Nov. 19, 2014 and which is fully incorporated by reference.

FIELD OF THE INVENTION

The presently disclosed subject matter relates generally to systems and methods for air mattress temperature control, particularly systems and methods for controlling the temperature of air contained within the air mattress.

BACKGROUND

Air mattresses are commonly used in lieu of traditional box-spring mattresses, memory foam mattresses, water beds, and other beds as temporary structures for humans to sleep on. Typically, air mattresses consist of a soft and flexible material chamber with an air-tight seal that allows the air mattress to inflate during use and deflate after use. While some air mattresses must be manually inflated by the human user, many air mattresses include a manual or an electric pump to mechanically inflate an air mattress. To convenience the user, some air mattress chambers feature built-in electric air pumps that receive power through an electrical cord plugged into a standard high voltage power source or a portable power source (e.g., a battery).

While built-in electric air pumps may conveniently inflate and deflate the air mattress, they may lack other features desired by users. Specifically, a built-in electric air pump may be unable to heat or cool the air within the air mattress, thereby allowing a user to adjust and control the temperature of the air mattress surface.

Accordingly, there is a need for improved systems and methods to address the above mentioned deficiencies. Embodiments of the present disclosure are directed to these and other considerations.

SUMMARY

Briefly described, embodiments of the presently disclosed subject matter relate to systems and methods for air mattress temperature control. In some examples, a temperature control element may be part of a built-in electric air pump or may be independently connected to the chamber of the air mattress.

In some embodiments, an air temperature control system may control the air temperature inside of an air mattress, or control the air temperature of sections within the air mattress. The air temperature control system may comprise an air intake component having inner and outer seals to inhibit or facilitate the flow of air into and out of the air mattress. The air temperature control system may also comprise a temperature control element in fluid communication with the air intake component. The temperature control element may be positioned within the air mattress inside of the outer seal. The air temperature control system may further comprise a controller configured to direct the opening and closing of the inner and outer seals and operation of the temperature control element.

In some further embodiments, a method for controlling air temperature of an air mattress having an air temperature control system may comprise receiving user input. The method may further comprise inflating the air mattress based on the user input. The method may also comprise closing an outer seal of the air temperature control system to inhibit the flow of air outside of the air mattress and allow air to flow from an air chamber inside of the air mattress to the air temperature control system. The method may further comprise controlling the temperature of air inside of the air mattress based on the user input. Optionally, the method may also comprise closing an inner seal to inhibit the flow of air from the air chamber to the air temperature control system.

The foregoing summarizes only a few aspects of the presently disclosed subject matter and is not intended to be reflective of the full scope of the presently disclosed subject matter as claimed. Additional features and advantages of the presently disclosed subject matter are set forth in the following description, may be apparent from the description, or may be learned by practicing the presently disclosed subject matter. Moreover, both the foregoing summary and following detailed description are exemplary and explanatory and are intended to provide further explanation of the presently disclosed subject matter as claimed.

BRIEF DESCRIPTION OF THE DRAWINGS

The accompanying drawings, which are incorporated in and constitute a part of this specification, illustrate multiple embodiments of the presently disclosed subject matter and, together with the description, serve to explain the principles of the presently disclosed subject matter; and, furthermore, are not intended in any manner to limit the scope of the presently disclosed subject matter.

Figure 1:
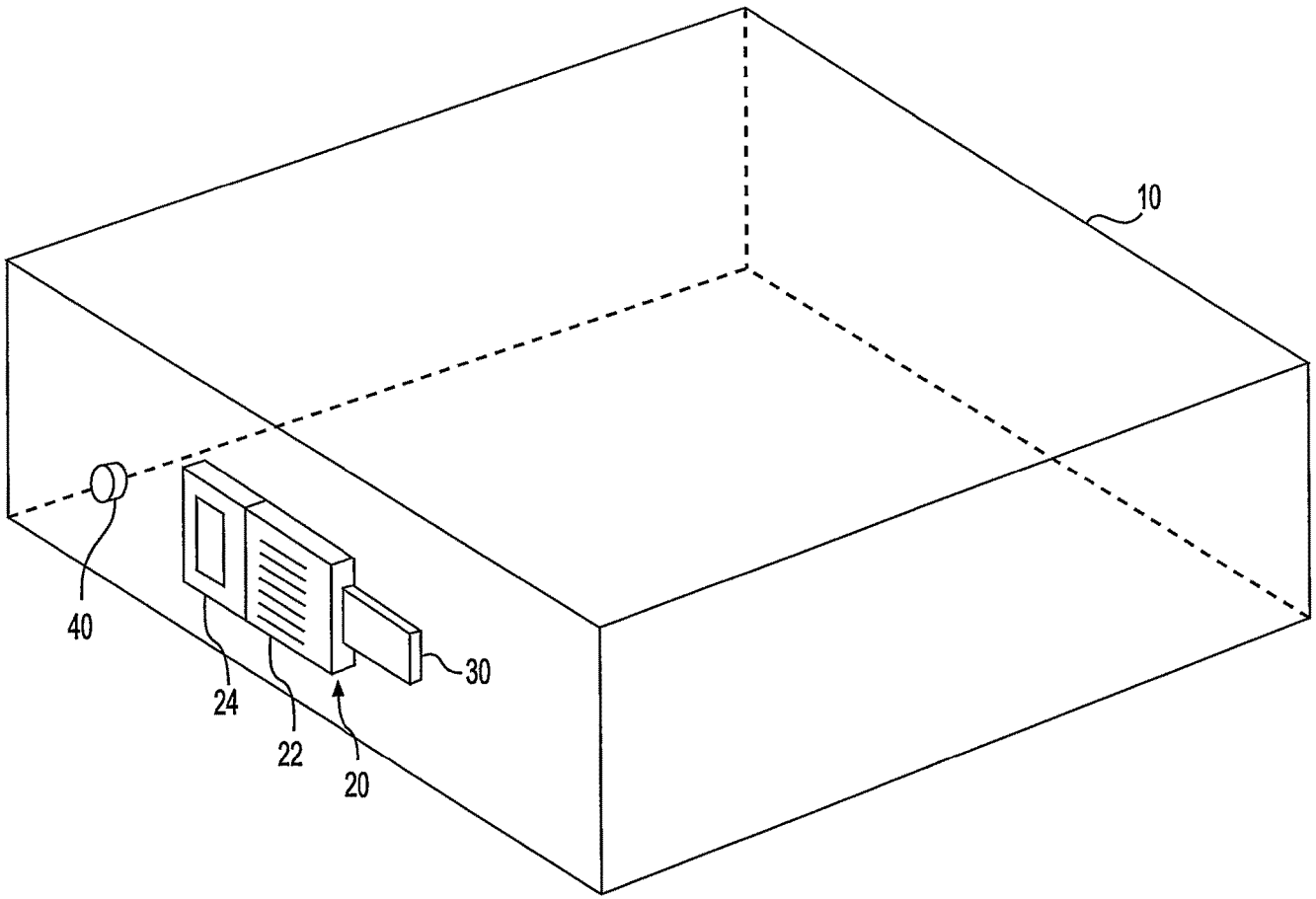
FIG. 1 is an isometric view of an exemplary embodiment of an air mattress having an air temperature control system, in accordance with an exemplary embodiment of the presently disclosed subject matter.

Any headings provided herein are for convenience only and do not necessarily affect the scope or meaning of the claimed presently disclosed subject matter.

DETAILED DESCRIPTION

The various embodiments of the presently disclosed subject matter are described with specificity to meet statutory requirements. However, the description itself is not intended to limit the scope of this patent. Rather, it has been contemplated that the claimed subject matter might also be embodied in other ways, to include different steps or elements similar to the ones described in this document, in conjunction with other present or future technologies.

It should also be noted that, as used in the specification and the appended claims, the singular forms "a," "an" and "the" include plural references unless the context clearly dictates otherwise. References to a composition containing "a" constituent is intended to include other constituents in addition to the one named. Also, in describing the preferred embodiments, terminology will be resorted to for the sake of clarity. It is intended that each term contemplates its broadest meaning as understood by those skilled in the art and includes all technical equivalents which operate in a similar manner to accomplish a similar purpose.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is also to be understood that the mention of one or more method steps does not preclude the presence of additional method steps or intervening method steps between those steps expressly identified. Moreover, although the term "step" may be used herein to connote different aspects of methods employed, the term should not be interpreted as implying any particular order among or between various steps herein disclosed unless and except when the order of individual steps is explicitly required.

The components described hereinafter as making up various elements of the invention are intended to be illustrative and not restrictive. Many suitable components that would perform the same or similar functions as the components described herein are intended to be embraced within the scope of the invention. Such other components not described herein can include, but are not limited to, for example, similar components that are developed after development of the presently disclosed subject matter.

To facilitate an understanding of the principles and features of the invention, various illustrative embodiments are explained below. In particular, the presently disclosed subject matter is described in the context of being an air temperature control system for an air mattress.

A user may desire to control the temperature of air inside of an air mattress. To control the air temperature, the user may inflate an air mattress and then heat or cool the air inside of the air mattress via an air temperature control system. Although the exemplary embodiments described herein are directed to an air mattress, the disclosed systems and methods may be equally applicable to any inflatable mattresses or mattresses filled with alternative fluids (e.g., helium, water, etc.).

Referring now to the figures, wherein like reference numerals represent like parts throughout the views, the connector system will be described in detail.

FIG. 1 depicts an isometric view of an exemplary embodiment of an air mattress 10 having an air temperature control system 20. Air mattress 10 may also have a portable power source 30 and an air release valve 40. Air mattress 10 may vary in size once inflated based on the size and number of users. For example, air mattress 10 may be a twin, full, queen, or king size bed. In some embodiments, the outer walls of air mattress 10 may form an inflatable air chamber configured to store air or other fluids. It is contemplated that air mattress 10 may form multiple inflatable air chambers. For example, air mattress 10 may have left and right side air chambers to allow a couple to independently inflate and/or control the temperature of the left and right halves of air mattress 10 as desired. Similarly, air mattress 10 may have a primary air chamber with separate head and/or foot air chambers. In this configuration, for example, the head air chamber may be inflated to a higher air pressure than the primary chamber to help the head air chamber better serve as a pillow, while the air within the foot air chamber may be hotter than air within the primary chamber to help warm a user's feet. In other embodiments, the outer walls of air mattress 10 may house one or more structurally independent air chambers. Air mattress 10 (and it's air chambers defined or housed within) may be constructed out of polyvinyl chloride ("PVC"). It is contemplated, however, that other materials such as other plastics or rubber may be used.

Portable power source 30 may be used to power air temperature control system 20 to control air temperature and to inflate and deflate the air mattress. In some embodiments, portable power source 30 may be a battery and provide direct current. In other embodiments, portable power source 30 may include a motor or generator and provide alternating current. It is contemplated that any portable power source may be used. Further, portable power source 30 may be housed in a power source housing (not shown) on air mattress 10 for convenient transport.

Air release valve 40 may be configured to inhibit the flow of air out of air mattress 10 when in a closed position and allow air flow out of air mattress 10 when in an open position. In some embodiments, air release valve 40 may move from the closed position to an open position when the air pressure inside of air mattress 10 exceeds a predetermined threshold. In such embodiments, air release valve 40 may serve as a safety valve to prevent damage to air mattress 10 during over-inflation. In other embodiments, air release valve 40 may comprise a removable plug that may be removed when a user desires to deflate air mattress 10. Air release valve 40 may be constructed out of polyvinyl chloride ("PVC"). It is contemplated, however, that other materials such as plastics or rubber may be used. In some embodiments, multiple air release valves 40 may be used as a relief valve for different components or sections holding air within air mattress 10.

Air temperature control system 20 may include an air intake component 22 and a controller 24. Air intake component 22 may be configured to direct ambient air (or externally housed air or compressed air) into air mattress 10 during mattress inflation and direct air from air mattress 10 during mattress deflation. Air intake component 22 may include an outer seal that inhibits or allows the flow of outside air into air temperature control system 20. Air intake component 22 may also include an inner seal (not shown) that inhibits or allows the flow of internal air between air temperature control system 20 and the air chamber of air mattress 10.

Controller 24 may be configured to receive user input and control the opening or closing of inner and outer seals, inflating and deflating of air mattress 10 via air temperature control system 20, and increasing or decreasing air temperature inside of air mattress 10 via air temperature control system 20. In some embodiments, controller 24 may include one or more processors having memory with instructions configured to execute the methods and operations described herein. Further, controller 24 may house or be in communication with a thermometer or thermocouple (or other device configured to measure temperature) for measuring the air temperature within air mattress 10. Controller 24 may optionally include a display for showing one or more of a current or desired air temperature within air mattress 10. In some embodiments, controller 24 may be in communication with a barometer (or other device configured to measure fluid pressure) for measuring the air pressure within air mattress 10, and the display may optionally show one or more of a current or desired air pressure within air mattress 10. Controller 24 may be configured to execute one or more operating modes. For example, operating modes may include inflation mode, deflation mode, air recirculation mode, heating mode, cooling mode, automatic air temperature control mode, and standby mode. In other embodiments, controller 24 may include one or more electronic components that allow a user to switch between modes.

Inflation mode may begin when controller 24 receives user input to inflate air mattress 10. In some embodiments, inflation mode may last until controller 24 receives additional user input to stop inflating air mattress 10. In other embodiments, controller may automatically control the speed and duration of inflation based on a predetermined or user supplied air pressure for the air in air mattress 10. During inflation mode, both the inner and outer seals are open to allow ambient air to flow into air mattress 10. In some embodiments, such as when air mattress 10 forms multiple air chambers, air temperature control system 20 may be in direct fluid communication with each air chamber and configured to control the air pressure, air temperature, and air flow speed within each air chamber individually. For example, air intake component 22 may include a plurality of inner seals each associated with a different air chamber, and controller 24 may open one or more of the inner seals at a time to achieve the desired air pressure, air temperature, and air flow speed in those air chambers. In other embodiments, two or more of the air chambers may be connected in series via valves (e.g., at least one air chamber in direct fluid communication with air temperature control system 20, and the remaining air chambers in indirect fluid communication with air temperature control system 20). It is contemplated that controller 24 may control the opening and closing of these valves to achieve the desired air pressure, air temperature, and air flow speed in those air chambers.

Deflation mode may begin when controller 24 receives user input to deflate air mattress 10. In some embodiments, deflation mode may last until controller 24 receives additional user input to stop deflating air mattress 10. In other embodiments, controller 24 may automatically control the speed and duration of deflation based on a predetermined or user supplied air pressure for the air in air mattress 10. Controller 24 may receive air pressure measurements from a barometer in fluid communication with the air in air mattress 10, and control the speed and duration of deflation based on these measurements and a predetermined or user supplied air pressure. During deflation mode, both the inner and outer seals may be open to allow ambient air to enter and exit air mattress 10. In some embodiments, such as when air mattress 10 forms multiple air chambers, the fluid communication between air temperature control system 20 and each air chamber may resemble that of the inflation mode described herein.

Air recirculation mode may begin when controller 24 receives user input to circulate air within air mattress 10. In doing so, controller 24 may direct outer seal to close while inner seal remains open, allowing air to enter air intake component 22, but not escape air mattress 10. Circulating air within air mattress 10 may cause a vibrating or massaging pulse on the surface of air mattress 10, adjust air temperature by mixing air within the air chamber with air within air temperature control system 20, and/or adjust air pressure via air temperature control system 20. In some embodiments, air recirculation mode may last until controller 24 receives additional user input to stop circulating air within air mattress 10. In other embodiments, controller may automatically control the duration and/or interval frequency to recirculate air within air mattress 10, thereby providing a periodic mixing of hot and cool to avoid hot or cool spots on air mattress 10 that may cause user discomfort and/or damage air mattress 10.

Heating mode may begin when controller 24 receives user input to heat air within air mattress 10. In doing so, controller 24 may direct outer seal to close while inner seal remains open, allowing air to enter air intake component 22, but not escape air mattress 10. Directing air within air mattress 10 through air temperature control system 20 may facilitate heating the air. In some embodiments, heating mode may last until controller 24 receives additional user input to stop heating air within air mattress 10. In other embodiments, controller may automatically control the speed and duration of heating air based on a predetermined or user supplied air temperature for the air in air mattress 10.

Cooling mode may begin when controller 24 receives user input to cool air within air mattress 10. In doing so, controller 24 may direct outer seal to close while inner seal remains open, allowing air to enter air intake component 22, but not escape air mattress 10. Directing air within air mattress 10 through air temperature control system 20 may facilitate cooling the air. In some embodiments, cooling mode may last until controller 24 receives additional user input to stop cooling air within air mattress 10. In other embodiments, controller may automatically control the speed and duration of cooling air based on a predetermined or user supplied air temperature for the air in air mattress 10.

Automatic air temperature/pressure control mode may begin when controller 24 receives user input to control the temperature of air within air mattress 10. In doing so, controller 24 may direct outer seal to close while inner seal remains open, allowing air to enter air intake component 22, but not escape air mattress 10. Directing air within air mattress 10 through air temperature control system 20 may facilitate controlling the air temperature. In some embodiments, automatic temperature control mode may automatically determine when the air temperature exceeds a first predetermined threshold and, based on the determination, heat or cool the air until the air temperature reaches a second predetermined threshold. For example, if the desired air temperature is 80 degrees and the temperature falls below 65 degrees, the first predetermined threshold, controller 24 may direct air to flow through air temperature control system 20 while air temperature control system 20 heats the air until the air temperature reaches 80 degrees, the second predetermined threshold. Similarly, in some embodiments, automatic pressure control mode may automatically determine when the air pressure exceeds a first predetermined threshold and, based on the determination, increase or decrease the air pressure until the air pressure reaches a second predetermined threshold. The user may provide user input before or during automatic air temperature/pressure control mode to change the first and/or second predetermined thresholds and other control settings, such as air flow speed. Different air flow speeds may be associated with different noise levels, and a user may desire a slow air flow speed while the user sleeps on air mattress 10 to limit the noise. Conversely, when a user is not sleeping on air mattress, the user may desire a faster air flow speed to heat the air more quickly or more evenly.

In further embodiments, such as when air mattress 10 forms multiple air chambers, air may be circulated, heated, cooled, pressurized, and/or automatically temperature/pressure controlled through each air chamber or group of air chambers independently. For example, when air temperature control system 20 is in direct fluid communication with each air chamber or group of air chambers (connected to one another in series), controller 24 may direct each inner seal to open separately, thereby allowing for different air temperatures, air pressures, and air flow speeds in each of the air chambers. In this configuration, for example, the air within an air chamber that the user desires to be warmer (e.g., a foot air chamber) may be recirculated and/or heated more frequently than another air chamber that the user desires to be colder (e.g., a head air chamber or a primary air chamber). Thus, the inner seal that allows for direct fluid communication between the foot air chamber and air temperature control system 20 may be opened while the other inner seals remain closed so air temperature control system 20 can recirculate and/or heat the air in the foot air chamber alone. Afterwards, a different inner seal associated with the primary air chamber may be opened while the other inner seals are closed, and air temperature control system 20 may, for example, cool the air in the primary chamber as it circulates. Further, if one air chamber requires more frequent control (e.g., it contains the warmest air, and thus, must be heated more frequently than other, colder air chambers), controller 24 may automatically increase the heating frequency and/or heating time duration as part of the automatic air temperature/pressure control mode. Similarly, in some embodiments, controller 24 may automatically control air pressure within each air chamber individually based on the user input.

Standby mode may occur when controller 24 receives power from portable power source 30 and is not placed in another mode. For example, controller 24 may operate in standby mode before receiving user input. In some embodiments, controller 24 may enter standby mode during automatic air temperature control mode in between heating and cooling cycles. During standby mode, air temperature control system 20 may not be directed to heat or cool the air and/or cause air flow. Controller 24 may direct outer seal to close to keep air within air mattress 10. In some embodiments, controller 24 may also direct inner seal to close to inhibit air recirculation. In other embodiments, controller 24 may direct inner seal to remain open. It is contemplated that air mattress 10 may only include the outer seal and not the inner seal.

Figure 2:
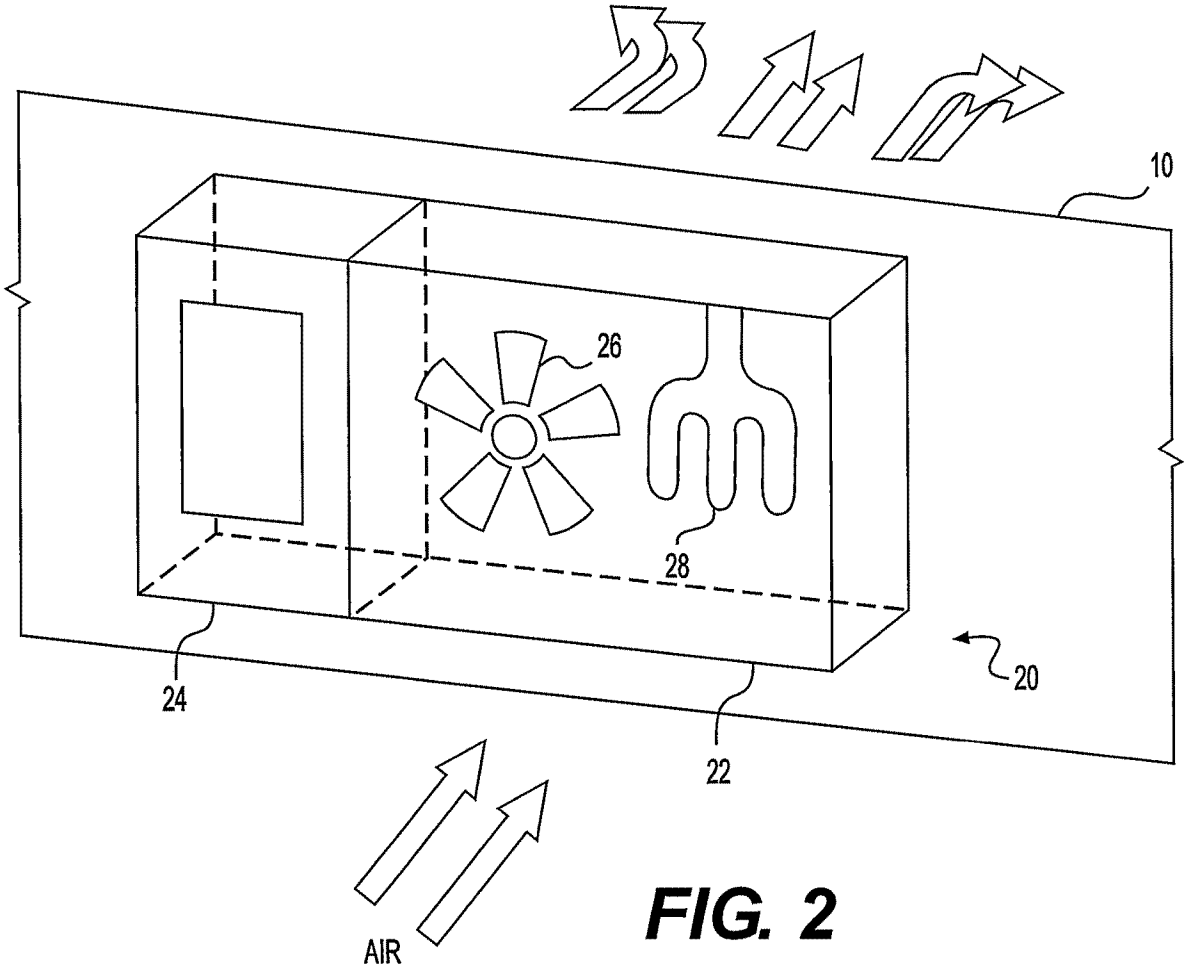
FIG. 2 is an isometric view of an exemplary embodiment of an air temperature control system showing ambient air flowing into an air mattress, in accordance with an exemplary embodiment of the presently disclosed subject matter.

FIG. 2 shows ambient air flowing into air mattress 10 via air temperature control system 20. As shown, ambient air may pass through an open outer seal, air temperature control system 20, and an open inner seal. Air intake component 22 may house a fan 26 and a temperature control element 28, which may be a heating element, a cooling element, or a combination thereof. Used herein, fan 26 may include any device for directing (e.g., blowing, suctioning, etc.) air into or out of air mattress 10. For example, fan 26 may have one or more spinnable blades angled to direct air. In other embodiments, fan 26 may be a motorized air compressor, vacuum, or another mechanical device for directing air flow and/or pressurizing air. Fan 26 may be made from PVC or other plastics, metals, or other hard materials. Portable power source 30 may power fan 26.

Temperature control element 28 may be configured to convert electricity from portable power source 30 into heat through the process of resistive heating. Temperature control element 28 may be constructed from one or more of nichrome, kanthal, cupronickel, incandescent lamps, ceramics, and other known materials for converting electricity into heat. As shown, temperature control element 28 may form a three-pronged structure that extends in the air path through air temperature control system 20. In this embodiment, increasing the surface area of temperature control element 28 may increase the speed at which heat element 28 can heat the air. It is contemplated that temperature control element 28 may take other forms, such as wire strips or coils. In some embodiments, temperature control element 28 may be a thermally conductive material that is heated and/or cooled via another heat source (not shown). Alternate designs of temperature control element 28 that may provide heating and/or cooling are contemplated.

Figure 3:
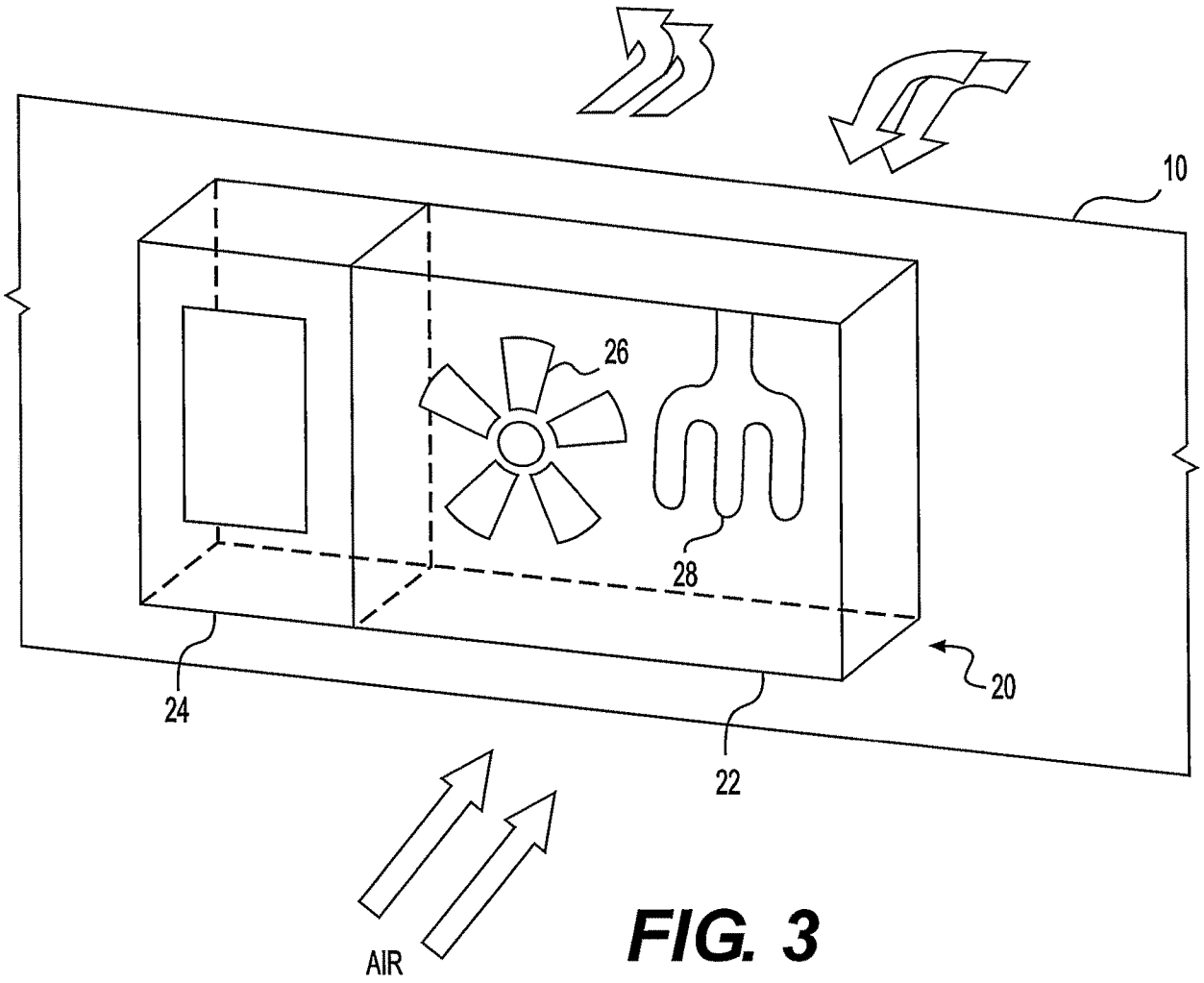
FIG. 3 is an isometric view of an exemplary embodiment of an air temperature control system showing ambient air flowing into an air mattress and recirculating within the air mattress, in accordance with an exemplary embodiment of the presently disclosed subject matter.

FIG. 3 shows ambient air flowing into air mattress 10 via air temperature control system 20 and recirculating within air mattress 10 and air temperature control system 20. As shown, ambient air may pass through an open outer seal, air temperature control system 20, and an open inner seal before circulating within air mattress 10 and entering air temperature control system 20. In some embodiments, the outer seal may act as a one-way valve based on the operating mode. For example, during inflation mode, the outer seal may be configured to only allow air to enter air mattress 10 while inhibiting the outflow of air. In contrast, the inner seal may be configured to allow for two-way air flow between the air chamber and air temperature control system 20.

Figure 4:
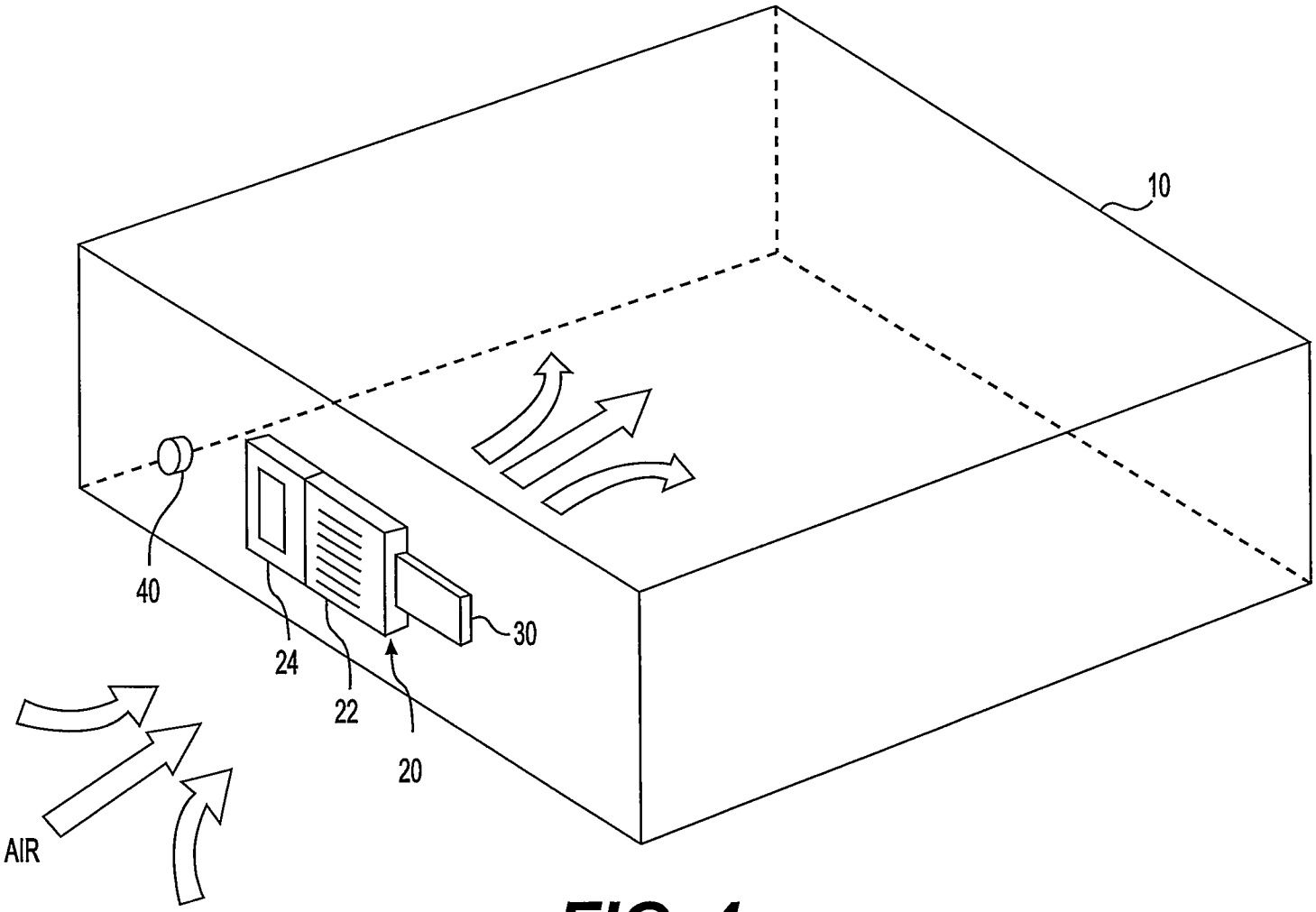
FIG. 4 is an isometric view of an exemplary embodiment of an air mattress showing ambient air flowing into the air mattress, in accordance with another exemplary embodiment of the presently disclosed subject matter.

FIG. 4 depicts air flow into air mattress 10 during the start of inflation mode. As shown, ambient air flows into air intake component 22 through an open outer seal, and passes through air temperature control system 20 and an open inner seal to the air chamber of air mattress 10. As described with respect to FIG. 2, air intake component 22 may draw in air via fan 26 and direct the air to flow past temperature control element 28. As air enters air mattress 10, air mattress 10 may inflate to its full size. In some embodiments, one or both of the inner and outer seals may comprise one-way valves that open to allow air to flow into air mattress 10 but not back out. The functionality of the valve(s) may change based on the operation mode. In other embodiments, one or both of the inner and outer seals may allow for two-way air flow. Further, the inner and/or outer seals may comprise two or more valves, with at least one of the valves allowing for two-way air flow and at least one of the valves allowing for one-way air flow. The number of and variety of valves used in the inner and outer seals may change based on the operation mode. Fan 26 may be configured to generate sufficient air flow to substantially prevent air from flowing out of air mattress 10. In some embodiments, as ambient (or external) air enters air mattress 10 through air temperature control system 20, heat element 28 may heat (or begin heating) the air to avoid or decrease the time required for the heating mode following the inflation mode.

Figure 5:
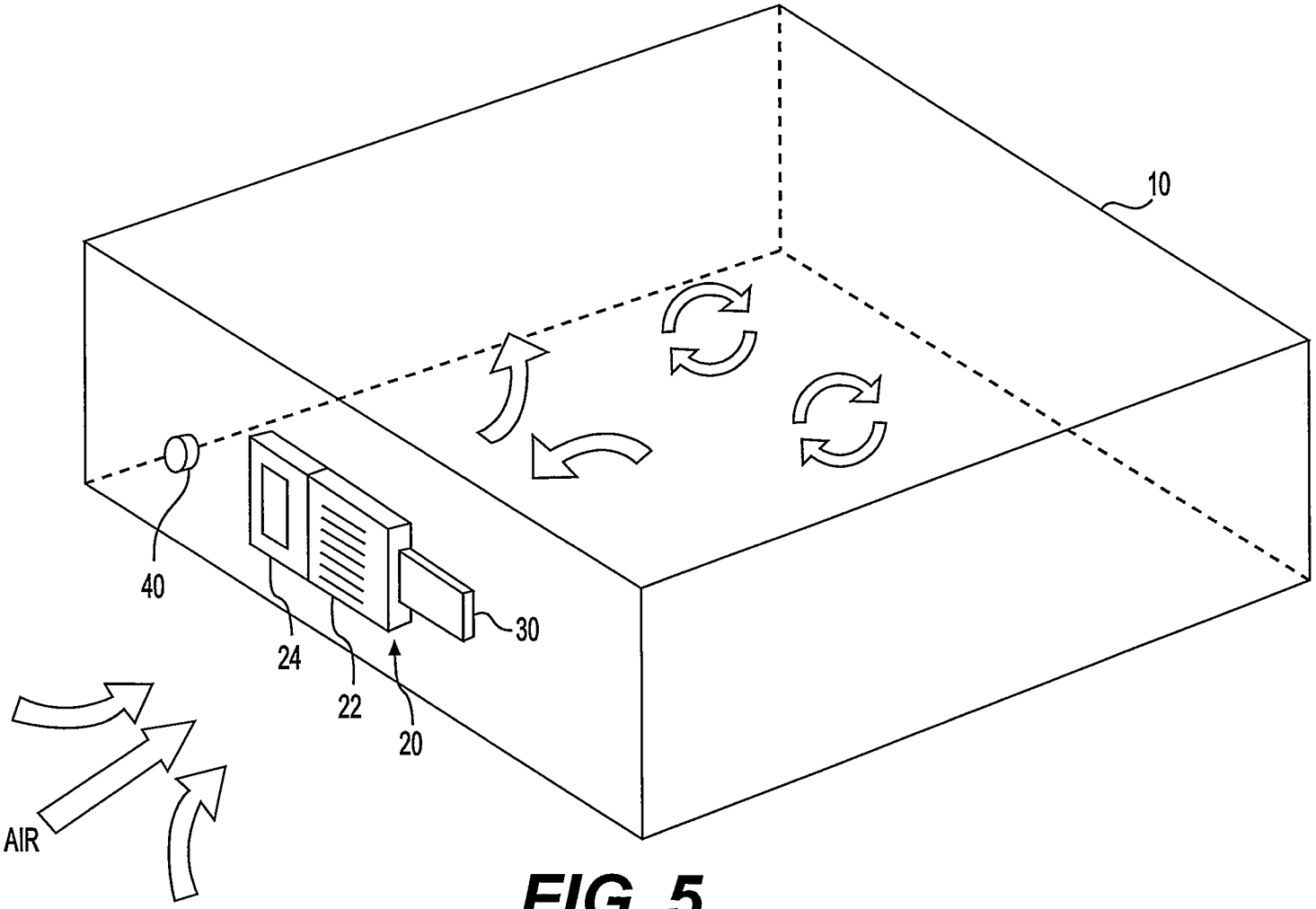
FIG. 5 is an isometric view of an exemplary embodiment of an air mattress showing ambient air flowing into the air mattress and recirculating within the air mattress, in accordance with an exemplary embodiment of the presently disclosed subject matter.

FIG. 5 depicts air flow into air mattress 10 and air recirculation during inflation mode. As shown, ambient air flows into air intake component 22, and passes through air temperature control system 20 to the air chamber(s). Then, once air enters the air chamber, it circulates before passing back into air temperature control system 20. In some embodiments, such as when air mattress 10 forms multiple air chambers, the air may circulate within each air chamber individually or may circulate within a plurality of air chambers (e.g., when the air chambers are connected in series) before passing back into air temperature control system 20. It is contemplated that the air directed back into air temperature control system 20 may reside in an air holding chamber while it is heated or cooled. In other embodiments, the air directed back into air temperature control system 20 mixes with ambient air entering air mattress 10. In such embodiments, the inner seal may allow for two-way air flow. Fan 26 may generate enough air flow to prevent air from flowing out of air mattress 10, but be positioned such that the internal air is allowed to flow in and out of air temperature control system 20 and be heated and/or cooled by temperature control element 28. For example, fan 26 may be housed upstream of temperature control element 28 within air temperature control system.

Figure 6:
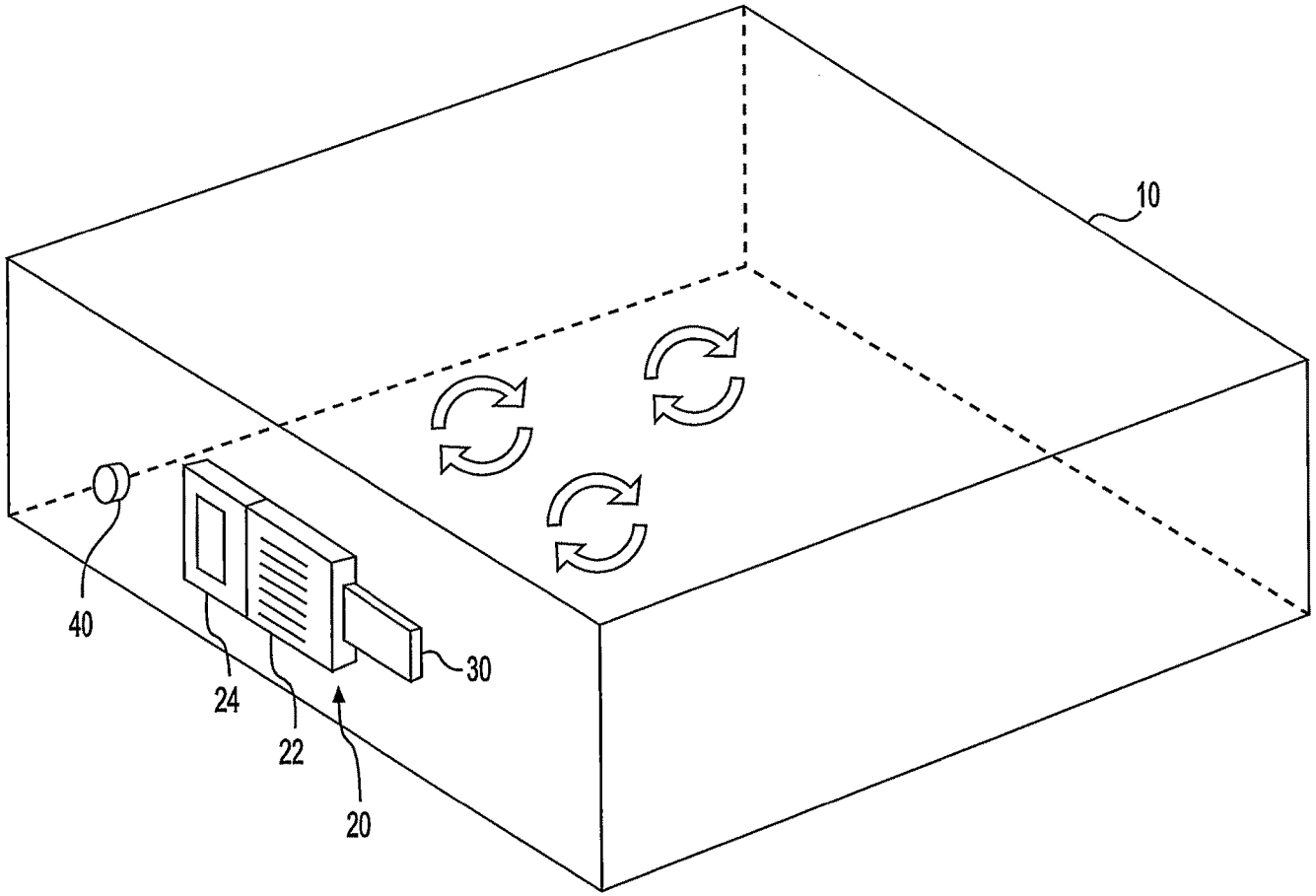
FIG. 6 is an isometric view of an exemplary embodiment of an air mattress showing air recirculating within the air mattress, in accordance with an exemplary embodiment of the presently disclosed subject matter.

FIG. 6 shows air circulating within air mattress 10 during air recirculation mode. As shown, the outer seal is closed following mattress inflation, inhibiting the flow of air into and out of air mattress 10. In some embodiments, the inner seal may be closed to prevent air flow from the air chamber (s) of air mattress 10 into and out of air temperature control system 20. It is contemplated that the air residing within the air chamber(s) may mix to form a uniform temperature. In other embodiments, the inner seal may be open to allow air flow between the air chamber(s) and air temperature control system 20. It is contemplated that the air inside the air chamber(s) and air temperature control system may mix as fan 26 continues to circulate the air and/or temperature control element 28 heats or cools the air inside of air temperature control system 20.

Figure 7:
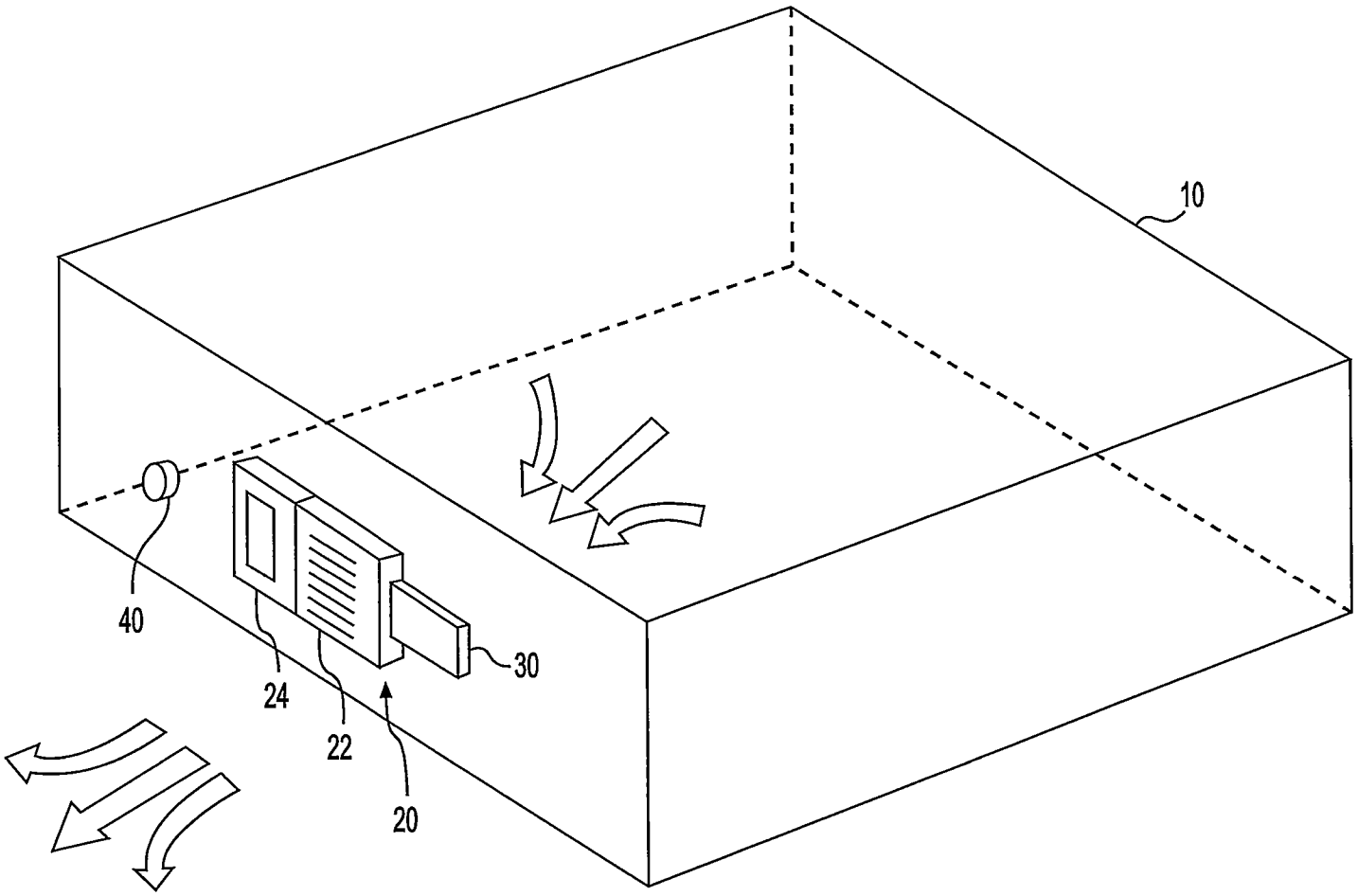
FIG. 7 is an isometric view of an exemplary embodiment of an air mattress showing air flowing out of the air mattress, in accordance with an exemplary embodiment of the presently disclosed subject matter.

FIG. 7 depicts air flowing out of air mattress 10 during deflation mode. As shown, the inner and outer seals are open to allow air to flow from the air chamber through air temperature control system 20 into the atmosphere. In some embodiments, inner and outer seals may include a two-way valve that allows air to directionally flow into and out of air mattress 10. Optionally, fan 26 may direct air out of air mattress 10. In such an embodiment, the inner and outer seals may have pressure valves that only allow air flow when a predetermined air pressure threshold is reached.

Figure 8:
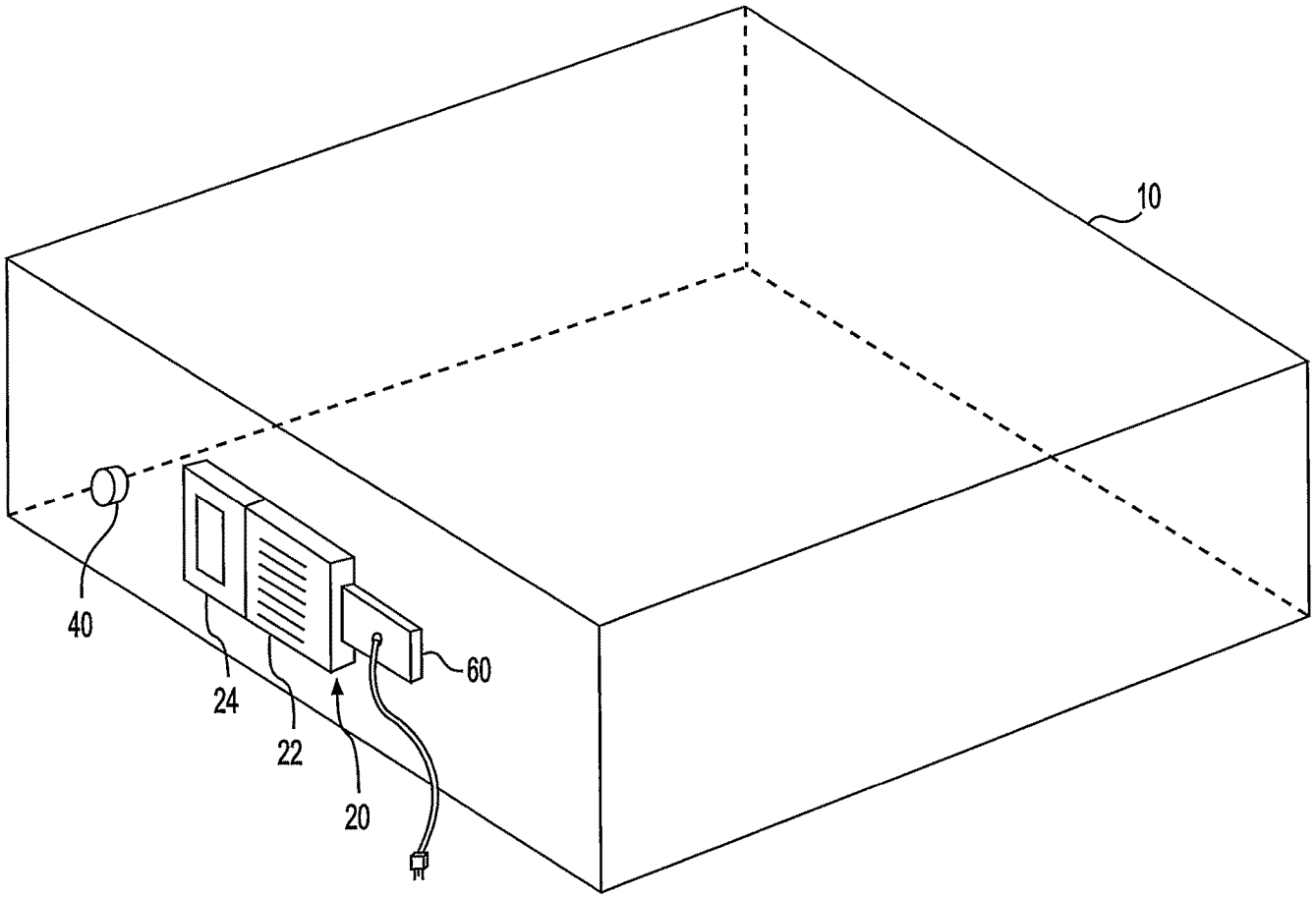
FIG. 8 is an isometric view of an exemplary embodiment of an air mattress having an air temperature control system, in accordance with an exemplary embodiment of the presently disclosed subject matter.

FIG. 8 shows another embodiment of air mattress 10 having a power plug 60. In this embodiment, power plug 60 may be used in lieu of portable power source 30 to power air temperature control system 20. While portable power source 30 may be used in outdoor and indoor locations, power plug 60 may be suited for indoor use when air mattress 10 is placed near an electrical outlet. It is contemplated that portable power source 30 may include an attachable power plug 60. Power plug 60 may include a variety of power plugs, such as those configured to plug into USB ports and 12V standard outlets.

Figure 9:
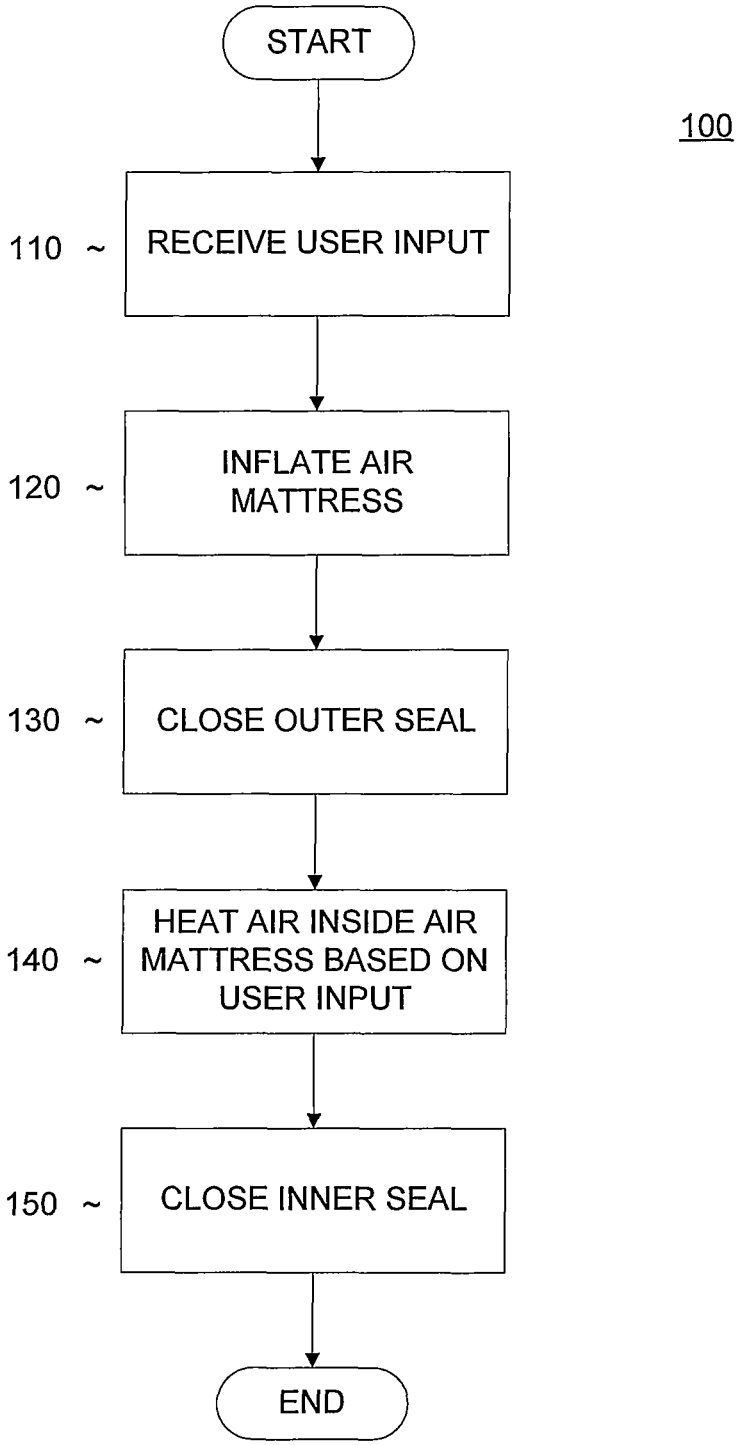
FIG. 9 is a flowchart showing an exemplary embodiment of a method for controlling temperature of air inside of an air mattress, in accordance with an exemplary embodiment of the presently disclosed subject matter.

FIG. 9 shows an embodiment of a method for controlling the air temperature 100 within air mattress 10. As shown, controller 24 may receive user input 110. For example, the user input may include a desired air temperature and/or a desired air pressure, or direct controller 24 to inflate or deflate air mattress 10. It is contemplated that user input may be reflected on a display of controller 24. Based on user input to inflate air mattress 10, controller 24 may direct air temperature control system 20 to inflate 120 air mattress 10. Specifically, fan 26 may draw in ambient air and direct the air into the air chamber(s) of air mattress 10. In some embodiments, temperature control element 28 may heat and/or cool the air as it initially enters air mattress 10. Once air mattress 10 is inflated to a desired level, as indicated by a barometer or other air pressure measurement device/sensor (not shown) in communication with controller 24 or by additional user input, controller 24 may direct the outer seal to close 130. By closing the outer seal, air cannot flow out of air mattress 10. Controller 24 may direct the inner seal to remain open, allowing for air to flow between the air chamber and air temperature control system 20. While the outer seal is closed and the inner seal is open, controller 24 may direct temperature control element 28 to heat/cool or continue to heat/cool the air 140 within air mattress 10 based on the received user input. Controller 24 may continue to operate in heating mode or cooling mode until a desired temperature threshold is reached. When a desired temperature threshold is reached, controller 24 may direct inner seal to close 150, thereby inhibiting the flow of air between the air chamber and air temperature control system 20. In other embodiments, such as during automatic air temperature control mode, inner seal may remain open or air mattress 10 may not include an inner seal between air temperature control system 20 and the air chamber. In embodiments involving multiple air chambers, controller 24 may direct a first inner seal (corresponding with a first air chamber) to open while the others are closed, and operate air temperature control system 20 in one of the operating modes (e.g., heating mode, cooling mode, etc.) until a desired temperature threshold is reached in the first air chamber. Then, controller 24 may close the first inner seal and open another inner seal or seals (previously closed), and operate air temperature control system 20 in one of the operating modes (e.g., heating mode, cooling mode, etc.) until a desired temperature threshold is reached in the second air chamber or group of air chambers.

Figure 10:
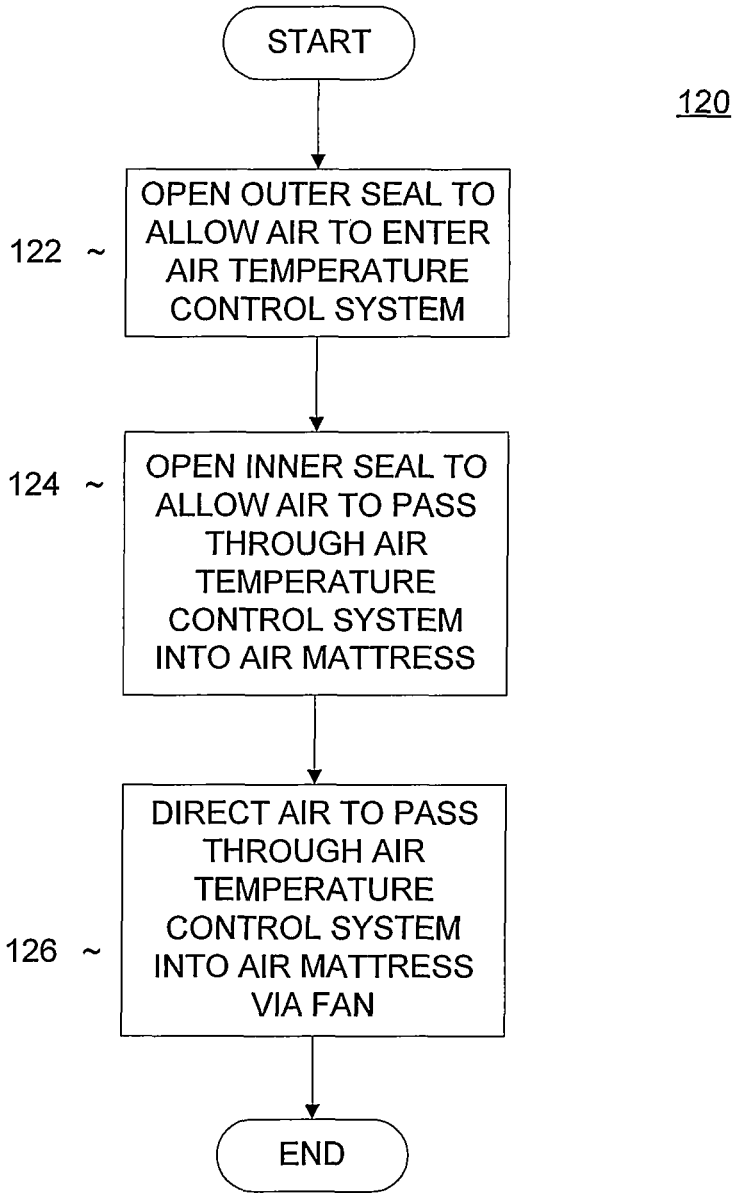
FIG. 10 is a flowchart showing an exemplary embodiment of a method for directing ambient air to enter and inflate an air mattress, in accordance with an exemplary embodiment of the presently disclosed subject matter.

FIG. 10 depicts an embodiment of inflating 120 air mattress 10. As shown, controller 24 may direct the outer seal to open 122 to allow air to enter air temperature control system 20. Then controller 24 may direct the inner seal to open 124 to allow the air to pass through air temperature control system 20 into the air chamber(s) of air mattress 10. Controller 24 may then direct air to pass through air temperature control system 20 into the air chamber(s) of air mattress 10 via fan 26. Controller 24 may be configured to control the air flow speed based on user input or predetermined settings.

Figure 11:
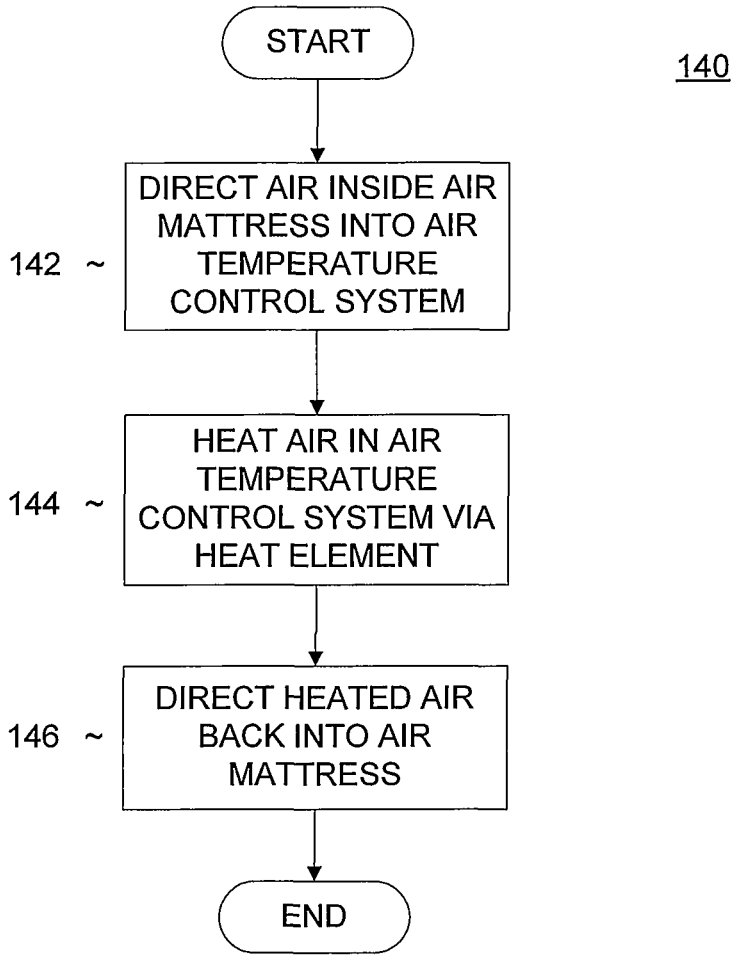
FIG. 11 is a flowchart showing an exemplary embodiment of a method for heating air inside of an air mattress, in accordance with an exemplary embodiment of the presently disclosed subject matter.

FIG. 11 depicts an embodiment of heating/cooling the air 140 inside of air mattress 10 based on the received user input. As shown, controller 24 may direct air 142 inside air mattress 10 into air temperature control system 20 via fan 26. Optionally, controller 24 may not operate fan 26 and instead allow air to slowly flow into air temperature control system 20 by itself. Controller 24 may then direct heat element 28 to heat or cool air 144 inside of air temperature control system 20. As the air flows past the surface of heat element 28, heat energy from heat element 28 may transfer into the air. Air may continuously flow through air temperature control system 20 while it is heated. It is contemplated, however, that the inner seal may be closed and allow for portions of air within air mattress 10 to be heated in predetermined time intervals. After the air is heated by heat element 28, controller 24 may direct the heated air back 146 into air mattress 10 via fan 26. The heating/cooling of air 140 inside of air mattress 10 may be continued until a desired air temperature is reached. Controller 24 may remain in communication with the thermometer within air mattress 10 and determine when the air temperature exceeds a threshold. Controller 24 may similarly control the air pressure within the air chamber(s) of air mattress 10 based on user input and measurements from a barometer.

Figure 12:
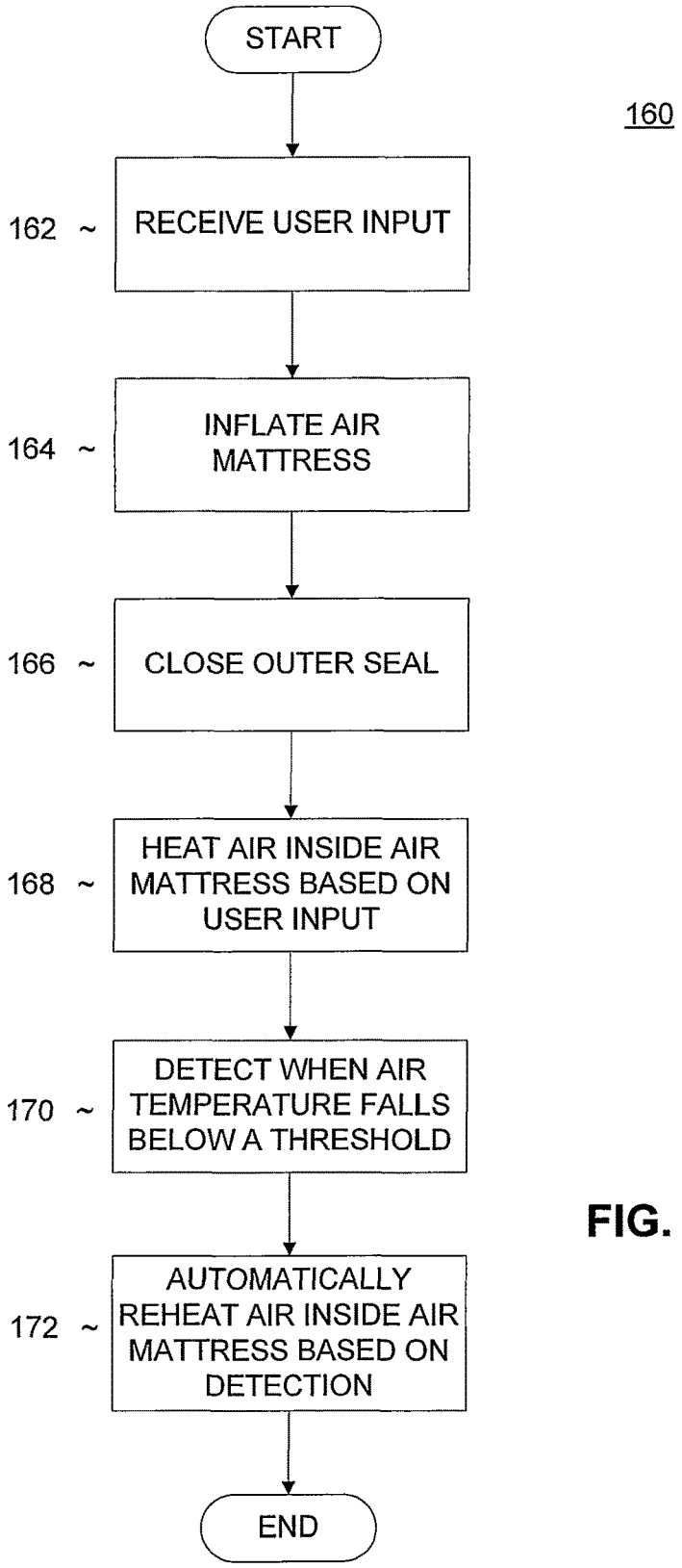
FIG. 12 is a flowchart showing an exemplary embodiment of a method for automatically controlling temperature of air inside of an air mattress, in accordance with an exemplary embodiment of the presently disclosed subject matter.

In another embodiment of a method for automatically controlling air temperature 160 within air mattress 10, as shown in FIG. 12, air mattress 10 may not include the inner seal or controller 24 may direct inner seal to remain open. As shown, controller 24 may receive user input 162, such as a desired air temperature and/or a desired air pressure, or direct controller 24 to inflate or deflate air mattress 10. It is contemplated that user input may be reflected on a display of controller 24. Based on user input to inflate air mattress 10, controller 24 may direct air temperature control system 20 to inflate 164 air mattress 10. Specifically, fan 26 may draw in ambient air and direct the air into air mattress 10. In some embodiments, temperature control element 28 may heat the air as it initially enters air mattress 10. Once air mattress 10 is inflated to a desired level, as indicated by an air pressure sensor (not shown) in communication with controller 24 or by additional user input, controller 24 may direct the outer seal to close 166. By closing the outer seal, air cannot flow out of air mattress 10. In embodiments where air mattress 10 includes the inner seal, controller may direct the inner seal to remain open to allow the air to flow freely between the air chamber and air temperature control system 20.

While the outer seal is closed controller 24 may direct temperature control element 28 to heat/cool or continue to heat/cool the air 168 within air mattress 10 based on the received user input. Controller 24 may continue to operate in heating mode or cooling mode control mode until a desired temperature threshold is reached. When a desired temperature threshold is reached, controller 24 may enter automatic air temperature control mode. During automatic air temperature control mode, controller 24 may detect whether the air temperature falls below a threshold 170. When controller 24 detects that the air temperature has fallen below the threshold, controller 24 may automatically direct temperature control element 28 to reheat and/or re-cool the air 172 inside of air mattress 10 based on the detection. In some embodiments, controller 24 may direct temperature control element 28 to heat and/or cool the air until the air temperature reaches a desired level based on the user input. In other embodiments, controller 24 may direct temperature control element 28 to heat and/or cool the air until the air temperature exceeds the desired level by a threshold based on the time it took for controller 24 to detect that the air had fallen below or above a threshold 170.

Based on the receive user input or new user input, controller 24 may direct fan 26 to continue to circulate the air inside of air mattress 10 to mix the air until it achieves an about uniform air temperature. It is contemplated that controller may be in communication with two or more thermometers housed within air mattress 10 for determining when an about uniform air temperature has been reached. For example, an about uniform air temperature may be reached with each thermometer within air mattress 10 measures within two degrees Fahrenheit of each other. Controller 24 may similarly control the air pressure (e.g., achieve a uniform air pressure) within the air chamber(s) of air mattress 10 based on user input and measurements from a barometer.

In other embodiments, air temperature control system 20 may be used with a traditional air pump configured to inflate and deflate air mattress 10. In such embodiments, the air pump may be placed upstream or downstream of air temperature control system 20 and between the inner and outer seals.

Further, it is contemplated that one or more compressed air chambers may be used for holding and heating compressed air from fan 26. In such embodiments, temperature control element 28 may be positioned at upstream of fan 26. Air from air mattress 10 may flow into air temperature control system 20 and be heated by heat element 28 before being compressed by fan 26. Compressing the heated air increase the air temperature. The heated compressed air may be stored in the compressed air chambers and used as an additional heat source for heating air within air mattress 10. For example, controller 24 may first direct air temperature control system 20 to heat air and fill the compressed air chambers as an additional heat source to heat element 28. Then, as air flows from air mattress 10 into air temperature control system 20, heat element 28 may initially heat the air before it is heated by passing the compressed air chambers. The compressed air chambers may be housed at different positions within air mattress where a user desires additional heat. For instance, the compressed air chambers may be housed where a user's feet would lie on air mattress 10, providing additional heat to that area of air mattress and/or continuing to heat air within air mattress 10 after heat element 28 has been turned off. It is contemplated that the walls of the air chambers holding compressed air may be thicker or made of stronger materials, as needed, to withstand the increased pressure of the compressed air. In some embodiments, ambient air may be compressed externally before entering air mattress 10. In other embodiments, air mattress 10 may further include a compressor or other device configured to pressurize the air within one or more of the air chambers of air mattress 10.

In some embodiments, controller 24 may control power consumption relative to mattress air temperature to ensure optional and efficient power consumption. For example, controller 24 may direct heat element 28 to heat the air in predetermined time internals or only for durations that exceed a time threshold based on efficient operation of heat element 28. That is, if heat element 28 consumes a substantial amount of power to heat itself compared to remaining heated, controller 24 may determine to only operate heat element 28 when the desired increase in air temperature may only be achieved by operating heat element 28 for a threshold duration of time to prevent unnecessary or undesirable heating and reheating of heat element 28.

By using the inner and outer seals to regulate the source of air flowing into air temperature control system 20 (e.g., ambient external air or air within air mattress 10), the air temperature control system 20 may efficiently control the air temperature within air mattress 10 without additional components for separate inflation/deflation and heating systems. It is contemplated that other regulation means may be used outside of the inner and outer seals, such as one or more regulator valves.

The air chamber(s) within air mattress 10 and air flow channels of air temperature control system 20 may be sized and shaped to facilitate optimal air flow within air mattress 10. Specifically, the air channels may be curved and/or include funnels to minimize undesired backflow of air within air mattress 10.

Figure 13A:
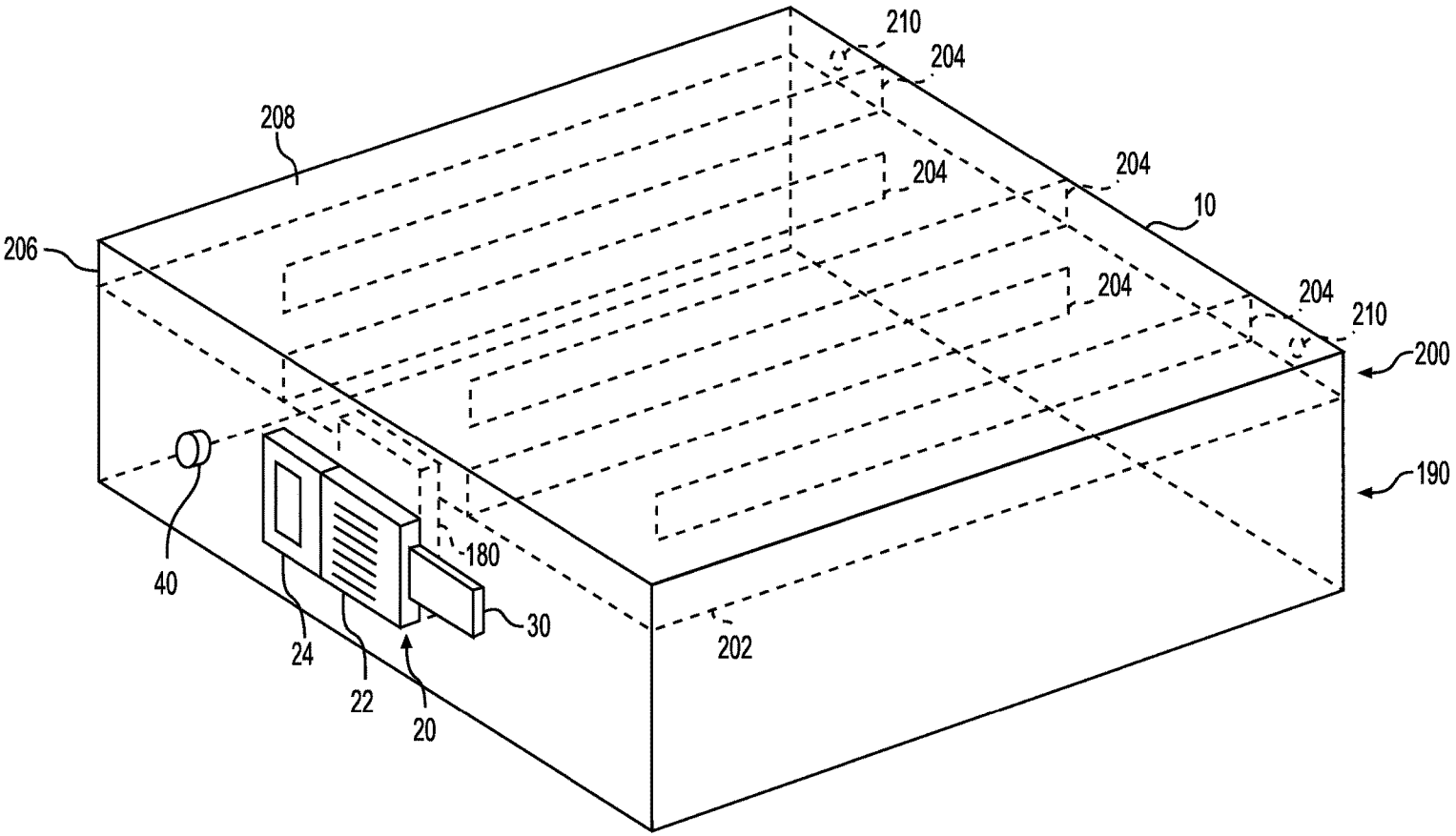
FIG. 13A is an isometric view of an exemplary embodiment of an air mattress having separate primary and temperature controlled air chambers, in accordance with an exemplary embodiment of the presently disclosed subject matter.
Figure 13B:
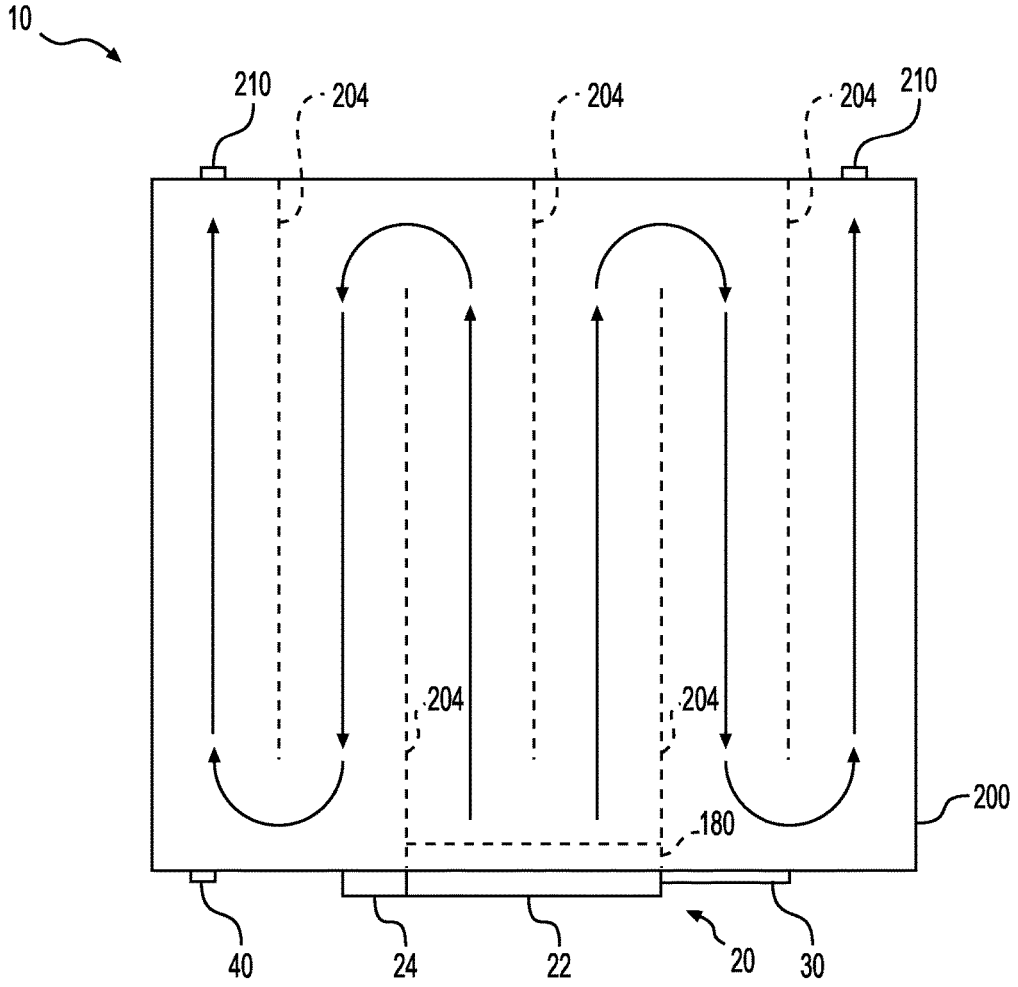
FIG. 13B is a top view of an exemplary embodiment of an air mattress showing air flowing through a temperature controlled air chamber, in accordance with an exemplary embodiment of the presently disclosed subject matter.
Figure 13C:
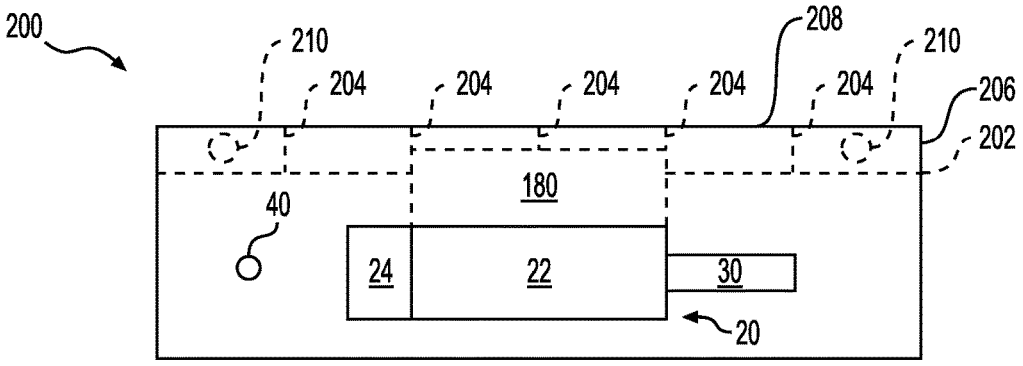
FIG. 13C is a front view of an exemplary embodiment of an air mattress having separate primary and temperature controlled air chambers, in accordance with an exemplary embodiment of the presently disclosed subject matter.

In some embodiments, air mattress 10 may have multiple air chambers with only the top air chamber(s) being temperature controlled. For example, as shown in FIGS. 13A-C, air mattress 10 may have a primary air chamber 190 positioned below a temperature controlled air chamber 200. In this fashion, the top surface of air mattress 10 may be temperature controlled and, to an extent, pressure controlled, without requiring heating, cooling, or pressurizing the entire air mattress 10, resulting in energy savings, reduced in-use costs, and decreased set-up and take-down times.

Temperature controlled air chamber 200 may be configured to receive air, directly or indirectly, from air intake component 22. For example, in some embodiments, air mattress 10 may have multiple air intake components 22 each configured to direct air into a corresponding air chamber. Alternatively, in other embodiments, air mattress 10 may have an air diverter valve 180 positioned downstream of air intake component 22, and be configured to selectively direct air into primary air chamber 190 or temperature controlled air chamber 200. It is contemplated that controller 24 may control operation of air diverter valve 180. In practice, in some embodiments, air intake component 22 may direct ambient air through air diverter valve 180 and into primary air chamber 90 to inflate primary air chamber 90, thereby causing air mattress 10 to substantially take shape. Then, controller 24 may direct heat element 28 to heat/cool the incoming ambient air and direct air diverter valve 180 to pass the heated/cooled air into temperature controlled air chamber 200.

Upon entering temperature controlled air chamber 200, the heated/cooled air may be directed into one or more air channels collectively formed by a bottom wall 202, a plurality of partitions, side walls 206, and a top wall 208. Shown in further detail in FIG. 13B, a first portion of the incoming heated/cooled air (shown as solid arrows) may be directed through air channels formed on the left side of temperature controlled air chamber 200, while a second portion of the incoming heated/cooled air (shown as solid arrows) may be directed through air channels formed on the right side of temperature controlled air chamber 200. In other embodiments, all of the heated/cooled air may be directed through the same air channel. It is contemplated that temperature controlled air chamber 200 may only form a portion of the top surface of air mattress 10 in some embodiments, for example, to provide temperature control to only desired areas (e.g., only heating/cooling a foot portion of air mattress 10, etc.).

In some embodiments, as shown in FIGS. 13A and 13B, partitions 204 may connect bottom wall 202, top wall 208, and one side wall 206, forming an air channel with a single outlet opening and a single inlet opening. In this configuration, the heated/cooled air (shown in solid arrows) may travel across a length of air mattress 10, pass into a subsequent air channel formed by a subsequent partition 204 or side wall 206, and travel across the length of air mattress 10 via the subsequent air channel. As the heated/cooled air approaches the end of the outermost air channel, it may be redirected back down the outermost air channel to recirculate within temperature controlled air chamber 200. In some embodiments, one or more air outlets 210 may be positioned at the end of the outermost air channel of temperature controlled air chamber 200. The air outlets 210 may include pressure relief valves configured to selectively release air from temperature controlled air chamber 200 once the air pressure within temperature controlled air chamber 200 exceeds a predetermined threshold. In this manner, newly heated/cooled air may be directed into temperature controlled air chamber 200 while the oldest air, which may become more ambient as it travels through temperature controlled air chamber 200, is released from temperature controlled air chamber 200 to achieve the desired temperature and pressure levels.

It is contemplated that one or more of partitions 204 may contain one or more apertures configured to allow a portion of air to pass through the partition 204, while directing most of the air down an air channel. Further, partitions 204 may contain one or more gates configured to selectively switch between open and closed positions to selectively facilitate the mixing of air within temperature controlled air chamber 200 or to allow air to pass to a certain region of temperature controlled air chamber 200 more quickly. They gates may also connect a partition 204 to an unconnected side wall 206 to selectively block air flow to one or more designated air channels, which may be useful to limit temperature or pressure levels to one section of air channels (e.g., if a user on the left side of air mattress 10 preferred cooler temperatures while a user on the right side preferred warmer temperatures).

Shown from the side view in FIG. 13C, temperature controlled air chamber 200 may be limited to a top portion of air mattress 10 to provide the user with the desired temperature (and to an extent, pressure) while using ambient air to substantially inflate air mattress 10 (e.g., by inflating primary air chamber 190 with ambient air rather than heated/cooled air). For example, temperature controlled air chamber 200 may have a depth of about 0.5 to about 6 inches in some embodiments, and about 1 to about 3 inches in other embodiments. It is contemplated that temperature controlled air chamber 200 may be pressurized to a desired air pressure without requiring the same air pressure within primary air chamber 190 to achieve a similar user experience to air mattress 10 having a single air chamber filled with pressurized air. In such embodiments, primary air chamber 190 may be at least substantially inflated with ambient air (or pressurized air).

While the present disclosure has been described in connection with a plurality of exemplary aspects, as illustrated in the various figures and discussed above, it is understood that other similar aspects can be used or modifications and additions can be made to the described aspects for performing the same function of the present disclosure without deviating therefrom. For example, in various aspects of the disclosure, methods and compositions were described according to aspects of the presently disclosed subject matter. However, other equivalent methods or composition to these described aspects are also contemplated by the teachings herein. Therefore, the present disclosure should not be limited to any single aspect, but rather construed in breadth and scope in accordance with the appended claims.

What is claimed is:

1. An inflatable air mattress comprising:

one or more inflatable air chambers disposed within the air mattress; and an air temperature control system in fluid communication with the one or more inflatable air chambers, the air temperature control system comprising:

an air intake component having an outer seal and an inner seal, the outer seal being configured to selectively open to allow air to enter and exit the air intake component and to selectively close to inhibit the air from entering or exiting the air intake component, the inner seal being configured to selectively open to allow the air to pass between the one or more inflatable air chambers and the air intake component and to selectively close to inhibit the air from entering or exiting the one or more inflatable air chambers, a fan in fluid communication with the air intake component, the fan being configured to selectively direct the air to flow into and out of the air mattress and to selectively circulate the air within the air mattress, a temperature control element in fluid communication with the air intake component, the temperature control element being configured to selectively heat and/or cool the air within the air intake component, and a controller configured to direct the opening and closing of the inner and outer seals and operation of the temperature control element and the fan.

2. The inflatable air mattress of claim 1 further comprising a thermometer in communication with the controller, the thermometer being configured to measure air temperature within the air mattress.

3. The inflatable air mattress of claim 1 further comprising an air release valve configured to selectively release the air from the air mattress when an air pressure within the air mattress exceeds a predetermined threshold.

4. An air temperature control system for an air mattress, the system comprising:

an air intake component having at least one outer seal configured selectively open to allow air to enter and exit the air intake component and to selectively close to inhibit the air from entering and exiting the air intake component and at least one inner seal configured to be in fluid communication with an inflatable compartment of the air mattress, the at least one inner seal further configured to selectively open to allow air to pass between the air intake component and the inflatable compartment and to selectively close to inhibit passage of air between the air intake component and the inflatable compartment;

a temperature control element configured to selectively heat and/or cool the air within the air intake component; and a controller configured to direct the opening and closing of the inner and outer seals and operation of the temperature control element.

5. The air temperature control system according to claim 4 further comprising a fan configured to selectively direct a flow of air into, out of, and within the air mattress.

6. The air temperature control system of claim 5, wherein the fan and the temperature control element are disposed within the air intake component.

7. The system of claim 4 further comprising a portable power source for powering the temperature control element and the controller.

8. The system of claim 4 further comprising a thermometer in communication with the controller, the thermometer being configured to measure air temperature within the air mattress.

9. The system of claim 8 further comprising a display in communication with the controller, the display being configured to show one or more of a current or a desired air temperature within the air mattress.

10. The system of claim 9 further comprising a barometer in communication with the controller, the barometer being configured to measure air pressure within the air mattress, wherein the display is further configured to show one or more of a current or a desired air pressure within the air mattress.

11. The system of claim 4, wherein the air intake component further comprises at least one inner seal configured to selectively open to allow the air that entered the air intake component via the outer seal to pass through the air intake component and to selectively close to inhibit the air from passing through the air intake component.

12. A method for controlling air temperature in an air mattress having an air temperature control system, the method comprising:

receiving, at a controller, a user input;

inflating one or more air chambers inside of the air mattress based on the user input;

closing an outer seal of the air temperature control system to inhibit deflation of the one or more inflated air chambers;

facilitating the passage of air between the one or more inflated air chambers and the air temperature control system; and controlling the temperature of the air inside of the one or more inflated air chambers based on the user input.

13. The method of claim 12 further comprising closing an inner seal of the air temperature control system to inhibit the passage of air between the one or more inflated air chambers and the air temperature control system.

14. The method of claim 13, wherein controlling the temperature of the air inside of the air mattress further comprises:

measuring the air temperature within at least one of the inflated air chambers;

determining, with the controller, when the measured air temperature exceeds a first predetermined threshold;

based on the determination, selectively opening the inner seal to allow the air to pass between the at least one of the inflated air chambers and the air temperature control system;

selectively heating and/or cooling, with the air temperature control system, the air within the air temperature control system based on the determination until the air temperature within the at least one of the inflated air chambers exceeds a second predetermined threshold.

15. The method of claim 14, wherein controlling the temperature of the air inside of the air mattress further comprises selectively directing the air within the air mattress to circulate at one of a plurality of predetermined air flow speeds based on the user input.

16. The method of claim 12, wherein facilitating the passage of air between the one or more air chambers and the air temperature control system comprises simultaneously opening an inner seal of the air temperature control system and mixing, via one or more fans, the air within the one or more air chambers and the air within the air temperature control system.

17. The method of claim 16, wherein the controller is configured to direct the opening of the inner seal and operation of the one or more fans for a predetermined duration.

18. The method of claim 16, wherein the controller is configured to repeatedly direct the simultaneous opening of the inner seal and operation of the one or more fans at predetermined intervals.

19. The method of claim 16, wherein controlling the temperature of the air inside of the air mattress comprises one or more of heating and cooling the air within the air temperature control system between the predetermined intervals.

20. The method of claim 12 further comprising controlling the air pressure within the air mattress based on the user input.

* * * * *